US006659924B1

(12) United States Patent
Hsu

(10) Patent No.: US 6,659,924 B1
(45) Date of Patent: Dec. 9, 2003

(54) TILTABLE TWISTING EXERCISER

(76) Inventor: Cheng-Hsiung Hsu, No. 29-18, Kou-Chien Lane, Kou-Chien Li, Lu-Kang Town, Changhua Hsien (TW)

( * ) Notice: Subject to any disclaimer, the term of this patent is extended or adjusted under 35 U.S.C. 154(b) by 0 days.

(21) Appl. No.: 10/408,306

(22) Filed: Apr. 8, 2003

(51) Int. Cl.[7] ..... A63B 22/16

(52) U.S. Cl. ..... 482/146; D21/670; D21/685; 482/146; 482/147; 482/907; 482/148; 482/121; 482/79; 482/80; 482/51; 482/52; 482/53

(58) Field of Search ..... D21/670, 685; 482/146, 147, 907, 148, 121, 79, 80, 51–53

(56) References Cited

U.S. PATENT DOCUMENTS

D281,343 S * 11/1985 Krive
4,693,470 A * 9/1987 Ogawa
4,953,858 A * 9/1990 Zelli
D473,272 S * 4/2003 Heins ..... D21/685
6,582,344 B2 * 6/2003 Tang ..... 482/53

* cited by examiner

*Primary Examiner*—Jerome W. Donnelly
(74) *Attorney, Agent, or Firm*—Troxell Law Office PLLC

(57) ABSTRACT

A tiltable twisting exerciser includes a base and a cover. The base has a top surface and a bottom surface. There are several fixing recesses disposed on the top surface. A rotatable disk is pivotally disposed the bottom surface. This cover is hinged on a first hinge portion of the base. This cover has an outer surface and an inner surface. A supporting portion is hinged on a second hinge portion which is fixed on the inner surface such that it can rotate out to a desired position. So, the user can do the twisting exercise on a sloped surface. The sloped surface is adjustable. And, it can be easily switch to one of the four operation modes.

4 Claims, 4 Drawing Sheets

TILTABLE TWISTING EXERCISER

BACKGROUND OF INVENTION

1. Field of the Invention

The present invention relates to a twisting exerciser, especially to a tiltable twisting exerciser. The user can do the twisting exercise on a sloped surface. The sloped surface is adjustable. And, it can be easily switch to one of the four operation modes.

2. Description of the Prior Art

Referring to FIG. 1, it shows a traditional twisting exercising device. It includes a fixing base 91 and a rotatable horizontal disk 92 on the fixing base 91. The user's both feet can stand on the horizontal disk 92 to do all kinds of twisting exercises. For example, the user can twist to the left and then twist to the right repeatedly as shown in FIGS. 2A and 2B. So, the basic horizontal twisting exercise can be achieved.

However, such left and right twisting is too monotonous and extremely tedious.

In addition, because both feet stand on a horizontal surface, there is no any stretching exercise or effect about the muscles of the user's legs. Thus, the leg exercising effect is quite limited.

SUMMARY OF THE INVENTION

The primary object of the present invention is to provide a tiltable twisting exerciser so that the user can do the twisting exercise on a sloped surface. The next object of the present invention is to provide a tiltable twisting exerciser. In which, its sloped surface is adjustable.

Another object of the present invention is to provide a tiltable exerciser that can be easily switched to one of the four operation modes. It has various exercising modes.

In order to achieve the above-mentioned objects, the present invention comprises:

a base having a top surface and a bottom surface, a plurality of fixing recesses disposed on said top surface, a rotatable disk rotatable attached to and protruding from said bottom surface; and a cover hinged on a first hinge portion of said base, said cover having an outer surface and an inner surface, a heel supporting portion disposed on said outer surface, a supporting portion hingably attached to a second hinge portion on said inner surface to allow rotation between a fold-in position and a fold-out position; wherein when said supporting portion is at the fold-in position, said supporting portion substantially contacts said inner surface so that said cover is positioned in a substantially horizontal position; when said supporting portion is at the fold-out position, one edge of said support portion engages into a fixing recess so that said cover is in a tilted position.

DETAILED DESCRIPTION OF THE PREFERRED EMBODIMENT

Figure 1:
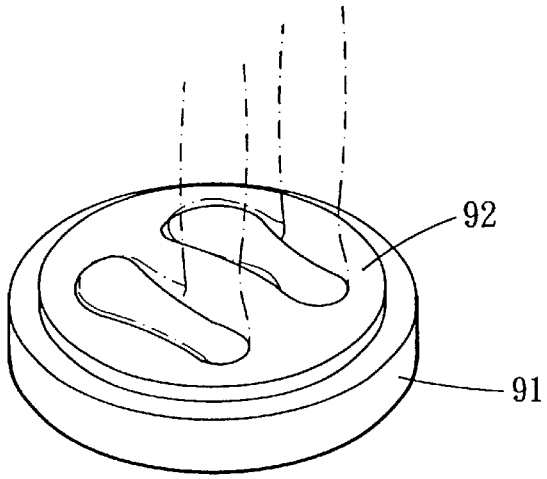
FIG. 1 (PRIOR ART)
FIG. 1 is a perspective view of the traditional twisting exerciser.
Figure 2A:
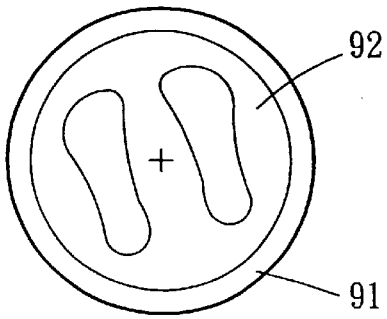
FIG. 2A (PRIOR ART)
FIGS. 2A and 2B show the user twisting to the left and to the right respectively.
Figure 2B:
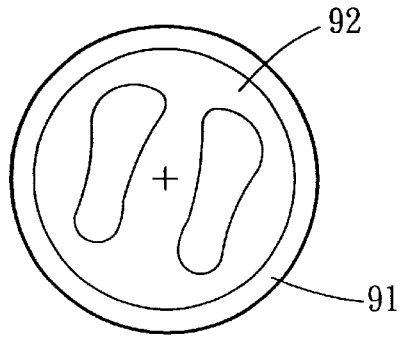
FIG. 2B (PRIOR ART)
Figure 3:
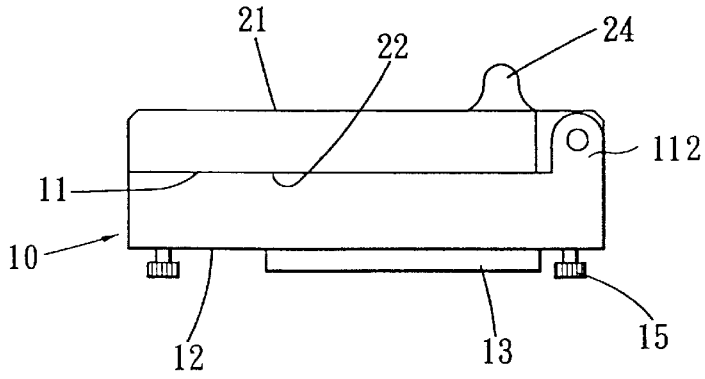
FIG. 3 is a side view of the present invention.
Figure 4:
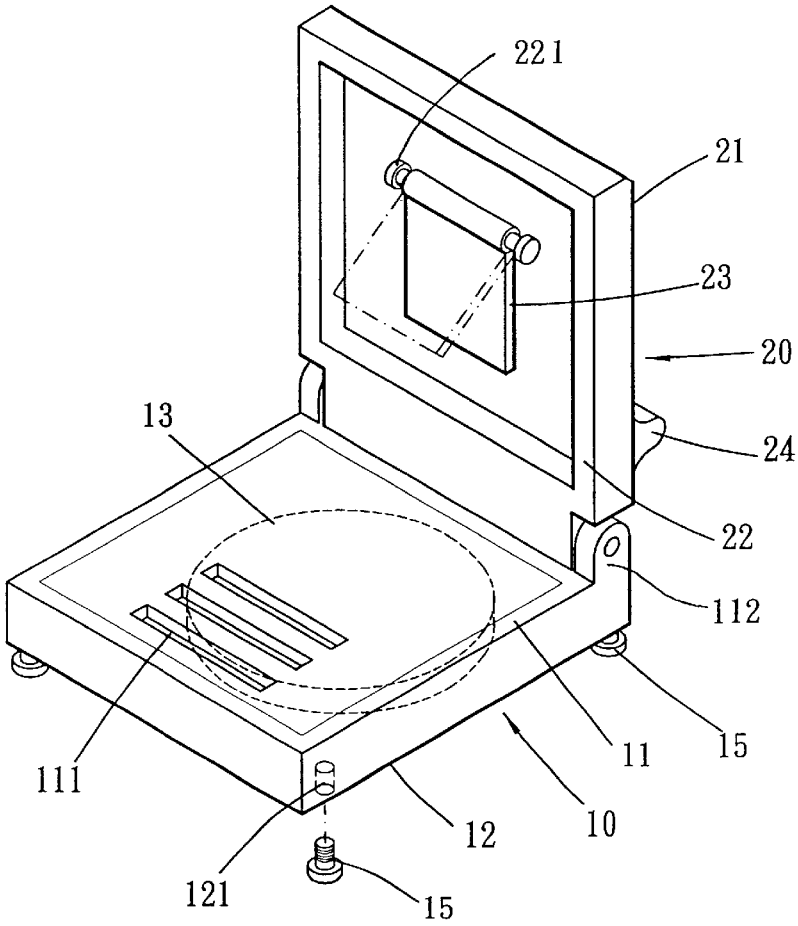
FIG. 4 is a perspective view of the present invention.

Referring to FIGS. 3 and 4, this invention is a tiltable twisting exerciser. It mainly comprises a base 10 and a cover 20.

With regard to the base 10, it has a top surface 11 and a bottom surface 12. A plurality of fixing recesses (or slots) 111 are disposed on the top surface 11. A rotatable disk 13 is pivotally disposed on the bottom surface 12 and the rotatable disk 13 is slightly protruded over the bottom surface 12. Furthermore, the bottom surface 12 of the base 10 includes at four receiving holes 121 (such as threaded holes) for inserting corresponding supporting elements 15 (such as threaded bolts) so that protruded lengths of the supporting elements 15 are adjustable.

Figure 5:
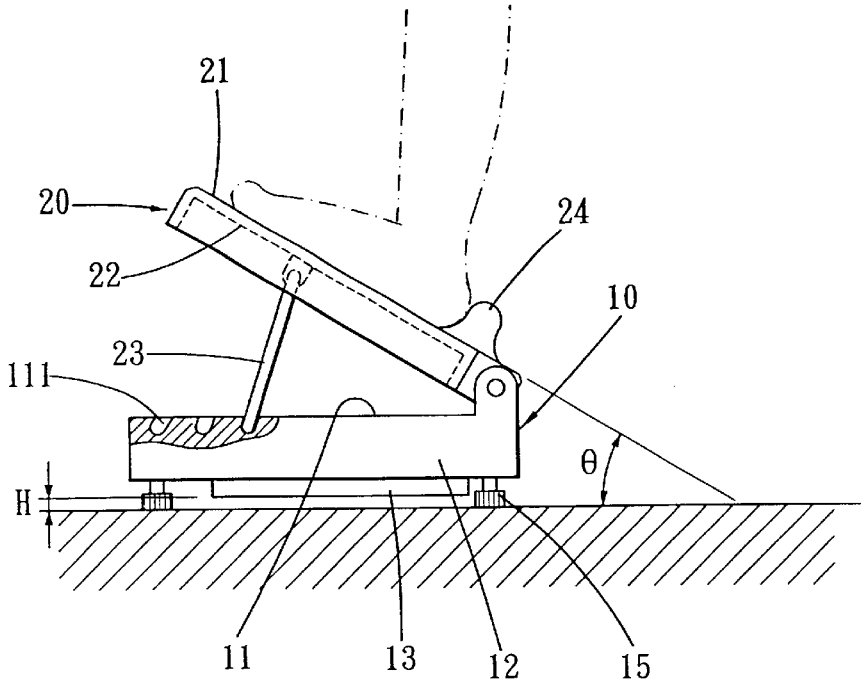
FIG. 5 shows one exercising condition of this invention.
Figure 6:
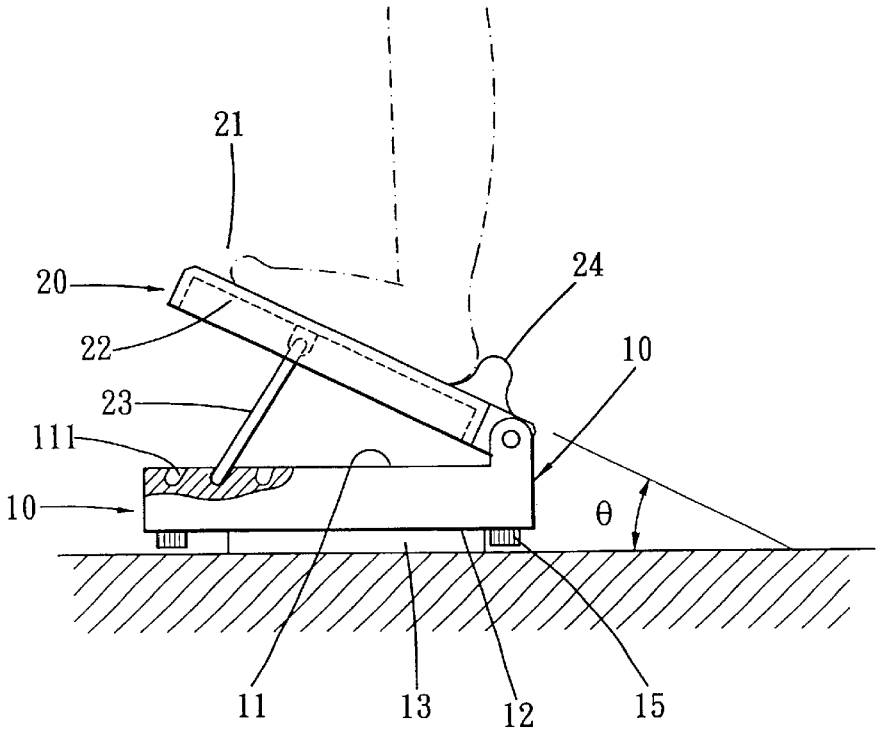
FIG. 6 shows another exercising condition of this invention.

The cover 20 is hinged on a first hinge portion 112 of the base 10. The cover 20 has an outer surface 21 (to support a user standing on) and an inner surface 22. A heel supporting portion 24 is disposed on the outer surface 21 for contacting the user's heels (to avoid slipping down). The supporting portion 23 is hinged on a second hinge portion 221 fixed on the inner surface 22 so as to rotate between a fold-in position (shown by the solid line in FIG. 4) and a fold-out position (shown by the phantom line in FIG. 4). Therefore, when the supporting portion 23 is at the fold-in position, said supporting portion substantially contacts (or is adjacent to) said inner surface so that said cover is substantially horizontal as shown in FIG. 3. When the supporting portion 23 is at the fold-out position, one edge of the support portion 23 engages into a desired fixing recess 111 so that the cover 20 is tilted (to form a sloped surface so that the user can stand on) as shown in FIGS. 5 and 6. Besides, the supporting elements 15 are adjustable to make said rotatable disk 13 contact to a ground or separate from a ground.

For the user, there are four different operation modes.

About the first operation mode, as shown in FIG. 5, the user lifts up the cover 20 first. After which, the user folds out the supporting portion 23 and then inserts into a suitable fixing recess (or slot) 111. So, it forms tilted condition having a tilting angle 0. And, the rotatable disk 13 is separated from the ground with a distance H. Therefore, the base 10 and the cover 20 are fixed (and kept unmoved). At this time, the user can stand on the sloped cover 20. It is very useful to stretch the muscles of the user's legs. If the user cooperates with other exercising movement for the user's body or hands, the overall exercising effect will be better.

About the second operation mode, referring to FIG. 6, the user lifts up the cover 20 first. After which, the user folds out the supporting portion 23 and then inserts into a suitable fixing recess (or slot) 111. So, it forms tilted condition having a tilting angle θ. But, because the supporting elements 15 have been rotated into the corresponding receiving holes 121, the rotatable disk 13 will contact to the ground. Thus, not only the user feels like standing on a slope, but also the entire base 10 and the cover 20 are rotatable. It will create a twisting exercising effect. Hence, the variety of the exercising is expanded.

Regarding the third operation mode, as shown in FIG. 3, the cover 20 is closed. And, the rotatable disk 13 is separated from the ground. The user can stand on the unmoved cover 20 as a flat exercising pad (such as for aerobic exercise).

Concerning the fourth operation mode, as illustrated in FIG. 3, all the supporting elements 15 are rotated into the corresponding the receiving holes 121 so that the rotatable disk 13 directly contacts with the ground (see the condition of the rotatable disk 13 shown in FIG. 6). Meanwhile, the entire base 10 and the cover 20 are rotatable so that it allows the user doing the twisting exercise. Therefore, this invention also can achieve the traditional function of the twisting exercise.

Figure 7:
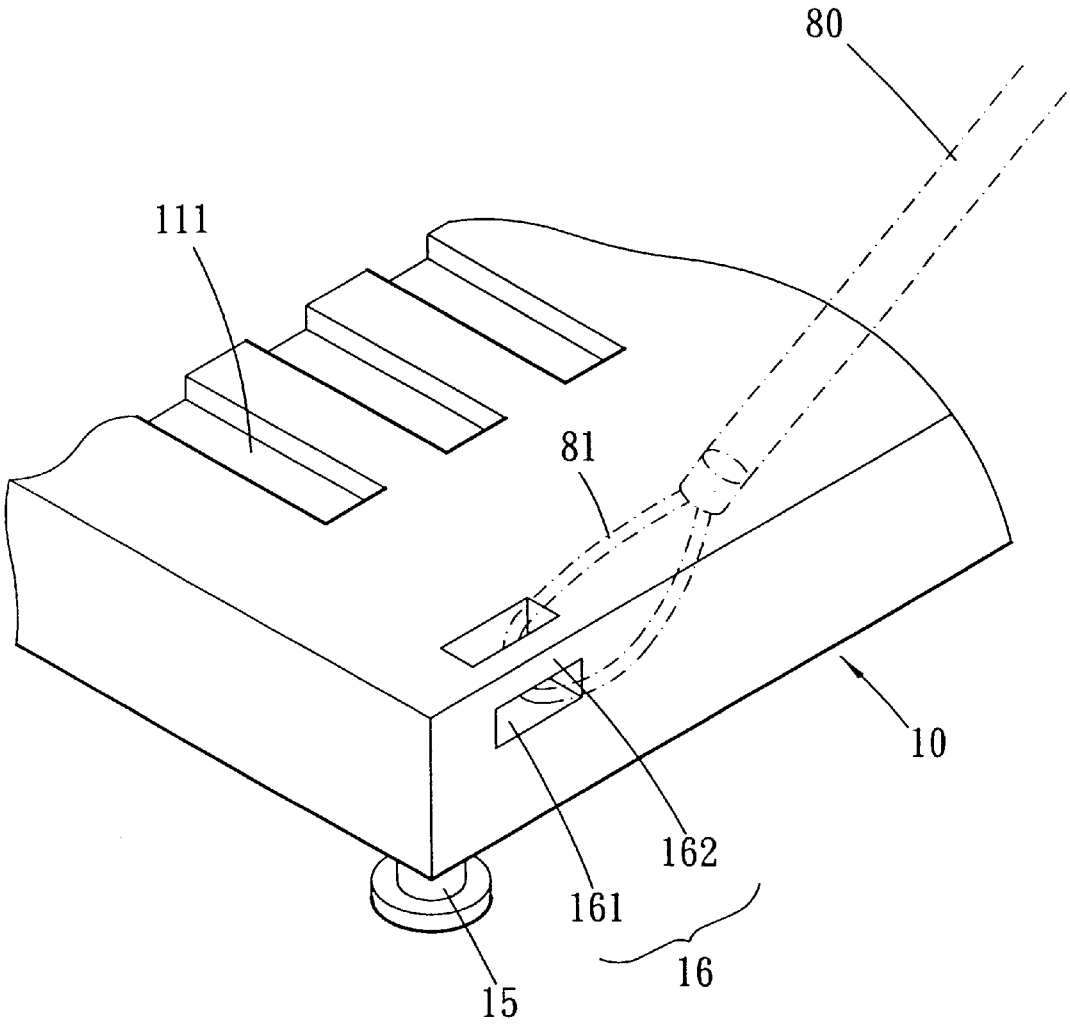
FIG. 7 shows a hooking portion of this invention.

In addition, referring to FIG. 7, a pair of hooking portions 16 (it only shows one hooking portion in FIG. 7) is disposed on two opposite sides of the base 10. Each hooking portion 16 has a hooking opening 161 and a hooking rod 162 so as to connect with one (or more) elastic exercising rope 80. That is, the hook 81 of the elastic rope 80 can connect with the hooking rod 162. Therefore, the user's hands can hold the other end (not shown) of the elastic rope 80 for exercising the arms.

The advantages and functions of the invention can be summarized as follows:

(1) The user can exercise on a sloped surface. By inserting the fold-out supporting portion 23 into a desired fixing recess 111, the cover 20 will be fixed at a tilted or sloped condition. So, the stretching effect for the muscles of the user's legs is enhanced. If cooperating with other exercise about the body or arms, the combined exercising effect will be better.

(2) The sloped surface is adjustable. By inserting into a specific fixing recess 111, a predetermined tilting angle will be obtained. Thus, the slope is adjustable.

(3) It is easy to switch to one of the four operation modes. This invention has four different operation modes. It can be easily switched. So, it is very convenient in use.

The above embodiments are only used to illustrate the present invention, not intended to limit the scope thereof. Many modifications of the above embodiments can be made without departing from the spirit of the present invention.

What is claimed is:

1. A tiltable twisting exerciser comprising:

a base having a top surface and bottom surface, a plurality of fixing recesses disposed on said top surface, a rotatable disk pivotally disposed on and protruding from said bottom surface;

a cover hinged on a first hinge portion of said base, said cover having an outer surface and an inner surface, a heel supporting portion disposed on said outer surface, a supporting portion hingably attached to a second hinge portion fixed on said inner surface to allow rotation between a fold-in position and a fold-out position; wherein when said supporting portion is at the fold-in position, said supporting portion substantially contacts said inner surface so that said cover is positioned in a substantially horizontal position; when said supporting portion is at the fold-out position, one edge of said support portion engages into a fixing recess so that said cover is in a tilted positioned.

2. The tiltable twisting exerciser as defined in claim 1, wherein said base further includes at least three receiving holes on said bottom surface for inserting corresponding supporting elements so that protruded lengths of the supporting elements are adjustable.

3. The tiltable twisting exerciser as defined in claim 2, wherein said receiving holes are threaded holes and said supporting elements are threaded bolts for rotatably engaging into said threaded holes; so that the supporting elements are adjustable to make said rotatable disk contact to a ground or separate from a ground.

4. The tiltable twisting exerciser as defined in claim 2, said base having a pair of hooking portions disposed on two opposite side of said base, each hooking portion having a hooking recess and a hooking rod so as to connect with one or more elastic exercising rope.

* * * * *